United States Patent [19]

Herdman

[11] 4,426,756

[45] Jan. 24, 1984

[54] SHOELACE KNOT RETAINER

[76] Inventor: Charles W. Herdman, 1253 Stirling Rd., Dania, Fla. 33004

[21] Appl. No.: 362,505

[22] Filed: Mar. 26, 1982

[51] Int. Cl.[3] ..... F16G 11/00

[52] U.S. Cl. ..... 24/119

[58] Field of Search ..... 24/117, 118, 119, 120, 24/121; 46/193, 191, 189

[56] References Cited

U.S. PATENT DOCUMENTS

D. 200,394 2/1965 Hakim .
2,674,021 4/1954 Cataldi ..... 24/119
3,106,003 10/1963 Herdman .
3,229,340 1/1966 Herdman .
3,321,815 5/1967 Herdman .
3,908,238 9/1975 Panicci ..... 24/119

*Primary Examiner*—Gene Mancene
*Assistant Examiner*—Kris R. Schulze
*Attorney, Agent, or Firm*—Berman, Aisenberg & Platt

[57] ABSTRACT

An improved shoelace knot retainer has a protective shoulder surrounding a bell which prevents the bell from becoming detached by the application of an external force, such as that caused by a child's crawling on the floor, by a child's chewing on the bell, or by the heel of a kicking shoe.

9 Claims, 4 Drawing Figures

SHOELACE KNOT RETAINER

BACKGROUND ART

Shoelace knot retainers are known in the art, and are of two general types. The first type comprises a cylinder having an axis transverse to the shoelace having a knot. This type of shoelace knot retainer is, for example, shown in U.S. Pat. No. 3,106,003 to Herdman, U.S. Pat. No. 3,229,340 to Herdman and in U.S. Pat. No. De. 200,394 to Hakim.

The second type of shoelace knot retainer comprises a generally cylindrical element where the shoelace having the knot to be retained lies in a direction which is generally parallel to the axis of the cylindrical element. A shoelace knot retainer such as this is shown in U.S. Pat. No. 3,321,815 to Herdman.

A shoelace knot retainer of either type mentioned above commonly has a bell fixed to it. In the first type of shoelace knot retainer, the bell is fixed to an end of a cylindrical element. Thus, as shown in the U.S. Pat. No. 3,229,340 to Herdman and in the design patent to Hakim, a bell may be centrally located on the cylindrical cap of a shoelace knot retainer of the first type. In the shoelace knot retainer shown in U.S. Pat. No. 3,229,340, the bell rests in a cylindrical recess in the cylindrical cap, which is for the sole purpose of providing a circular groove in the interior of the cap for securing the two parts of the knot retainer together.

It is also known to provide a bell on the shoelace knot retainer of the second type. The bell on this type of shoelace knot retainer, such as that shown in U.S. Pat. No. 3,321,815 to Herdman, is fixed to a central portion of the side wall of the cylinder which forms the shoelace knot retainer.

STATEMENT OF THE INVENTION

In recent years, there has been an increased awareness of the safety of consumer items. In particular, there has been an increasing scrutiny of articles which are used by small children to insure that pieces of the articles which are small enough to be swallowed do not become detached from the article. In many instances, the federal agency charged with regulation of consumer products has required products associated with children to be removed from the market because small pieces of the product could become detached and swallowed by a child.

It has been determined that the shoelace knot retainer of the second type described above, and shown by the U.S. Pat. No. 3,321,815, is susceptible to having the bell become dislodged by the application of an external force such as that caused by a child's crawling on the floor or by the kicking heel of the shoe of a child wearing the shoelace knot retainer. This problem arises because the bell is located along the cylindrical side wall of the knot retainer and protrudes from the retainer in a direction transverse to the cylindrical axis of the retainer. While the bell is secured to the retainer with a strong rivet, the possibility does nevertheless exist that the heel of a child's shoe, or another object can hit the knot retainer in the wedge-shaped space between the bottom of the bell and the outside surface of the knot retainer and dislodge the bell.

This problem does not present itself in the knot retainer of the first type because there the bell is placed on the flat end of the cylinder and the wedge-shaped space is less prominent.

Another problem is that a child might put the bell in his mouth when the knot retainer isn't in use. If the bell is not attached by a strong rivet the child might detach the bell by chewing. This problem may exist for either type of knot retainer because even if the bell is attached to a flat surface, a small wedge-shaped space still exists.

Thus, the prior art shoelace knot retainer presents a safety problem which in the past has been met by the use of a very strong rivet and a sturdy plastic mounting area for the bell and rivet, and by the maintenance of high quality control in manufacturing. These measures are expensive, and cannot be merely intensified to achieve greater safety. Furthermore, the present degree of safety cannot be achieved at reduced cost since the use of a less expensive means of attaching the bell risks the detachment of the bell.

The present invention includes a protective shoulder which surrounds the bell and protects it from being dislodged by a child, and thus insures more safety than could be economically attained by previous structure. The protective shoulder is generally cylindrical and extends around the bell and transverse to the axis of the cylindrical knot retainer. In the preferred embodiment, the protective shoulder extends to at least the height of the broadest part of the bell. By extending to at least the broadest part of the bell, the protective shoulder insures that there is no wedge-like space in which an object such as the heel of a child's shoe or the teeth of a child can catch, so that the bell is prevented from being dislodged.

It is an object of this invention to provide a safety feature for a shoelace knot retainer to insure that the bell does not become dislodged from the retainer.

It is another object of this invention to provide a shoulder which extends from the shoelace knot retainer and at least partially surrounds the bell to prevent the bell from being accidentally dislodged.

DETAILED DESCRIPTION OF THE DRAWINGS

Figure 1:
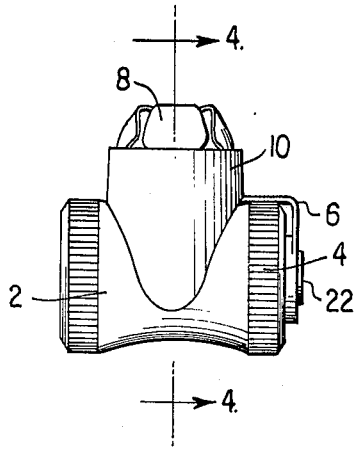
FIG. 1 is a side elevation view of the shoelace knot retainer showing the protective shoulder.

As shown in FIG. 1, the shoelace knot retainer comprises a generally cylindrical element 2 which fits over the knot in a child's shoelace to keep it from becoming untied. The generally cylindrical element 2 is closed at one end and open at its opposite end. The opposite end is shown closed by means of a cap 4 which contains threads which mate with threads on the generally cylindrical element. The cap 4 is prevented from becoming completely detached from the generally cylindrical element by means of a safety strap 6 which is fixed at one end to the cap 4 and to the generally cylindrical element 2 at its other end. A bell 8 extends from the mid-portion of the generally cylindrical element. A protective shoulder 10 at least partially surrounds the bell 8 and is in the form of a cylinder having an axis which is transverse to the axis of the generally cylindrical element 2.

Figure 2:
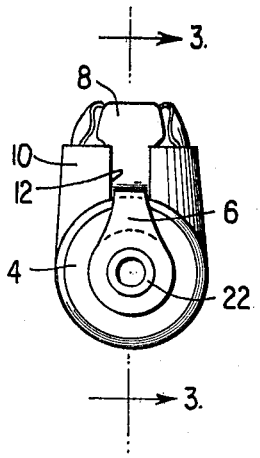
FIG. 2 is an end view of the shoelace knot retainer.

FIG. 2 shows an end view of the shoelace knot retainer and illustrates the slot 12 in the protective shoulder 10 which allows for the safety strap to pass through the protective shoulder.

Figure 3:
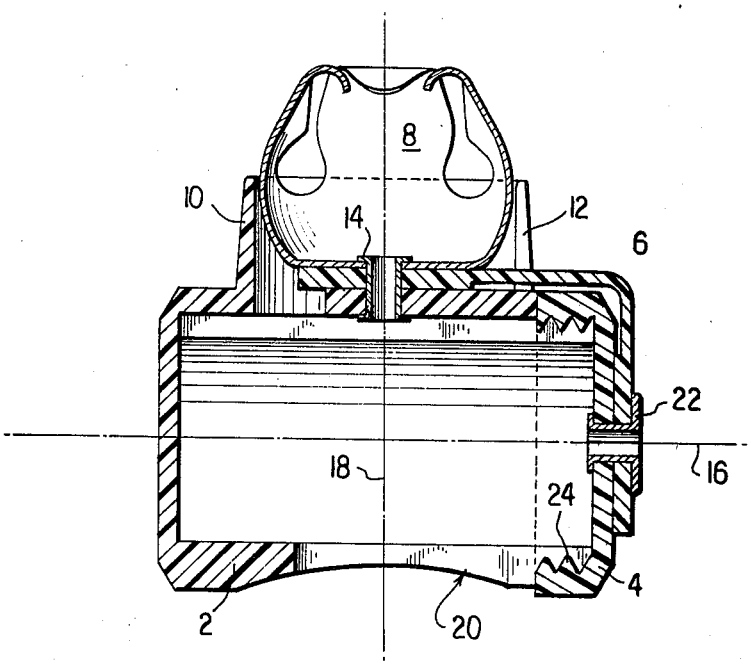
FIG. 3 is a cross section of the shoelace knot retainer taken along line 3—3 of FIG. 2.
Figure 4:
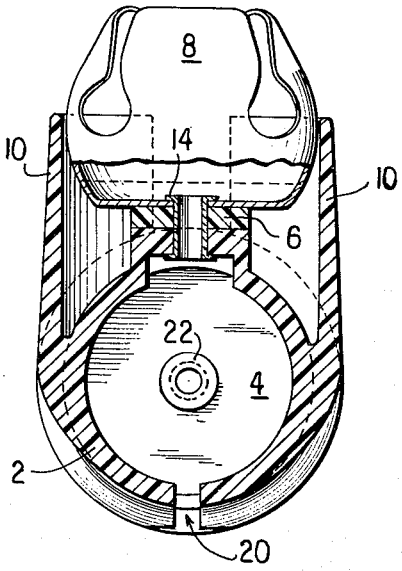
FIG. 4 is a cross section of the shoelace knot retainer taken along line 4—4 of FIG. 1.

As seen in FIG. 3, the structure of the improved shoelace knot retainer may be described with respect to the cylindrical axes 16 and 18. The generally cylindrical element 2 can be said to have a cylindrical axis 16 which is in the direction of the slot 20 located in the wall of the generally cylindrical element. The slot 20 allows the shoelace knot to be inserted into the interior of the cylinder. The protective shoulder 10 is also generally cylindrical and has an axis 18 which is transverse to the axis 16. In the preferred embodiment, axis 18 is normal to the axis 16.

FIG. 3 illustrates how the bell 8 is fixed to the generally cylindrical element 2 by means of a rivet 14. The rivet 14 extends through the bottom of the bell 8, the side wall of the generally cylindrical element 2, and the safety strap 6, and thus secures these three elements together. As seen in FIG. 3, the protective shoulder 10 extends to a point which is generally adjacent the broadest part of the bell, that is, the part of the bell having the largest cross-section in a plane perpendicular to the axis 18. This insures there is no wedge-shaped space for the heel of a child's shoe to become lodged.

As shown in FIG. 3, the safety strap 6 is fixed to the cap 4 by means of a second rivet 22, and the cap 4 contains threads 24.

An improved shoelace knot retainer has been described which provides for increased safety. A protective shoulder at least partially surrounds the bell to protect the bell from being dislodged by an object such as the heel of a kicking shoe. The protective shoulder extends in a direction transverse to the shoelace knot retainer for one type of retainer. When the top of the protective shoulder, for either type of retainer, is at least approximately adjacent the broadest part of the bell no significant wedge-shaped space exists which can receive the heel of a shoe or the teeth of a child. Since the bell walls above the protective wall converge, any force on the bell wall is deflected.

While the protective shoulder has been shown in the drawings as continuous except for the slot 12, it is to be understood that the shoulder may be designed in other forms. For example, other slots may be in the protective shoulder, but each of these slots must be narrow enough so that the heel of a shoe cannot pass through it.

What is claimed is:

1. A shoelace knot retainer comprising:

(a) knot retaining means having a generally cylindrical wall, with a cylindrical axis, closed at one end and open at an opposite end, (b) sound-generation means mounted on said generally cylindrical wall, and (c) protective means comprising a shoulder extending outwardly from said wall in a direction transverse to said axis and at least partially surrounding said sound-generation means in a plane transverse to said direction, (d) whereby said protective means protects said sound-generation means from being accidentally detached from said cylindrical wall.

2. The shoelace knot protector of claim 1 wherein said protective means is a generally cylindrical shoulder.

3. The shoelace knot retainer of claim 2 wherein the top of said protective means extends to at least the height of said sound-generation means having the largest cross section in a plane perpendicular to said direction.

4. The shoelace knot retainer of claim 2 wherein the dimension of said sound-generation means, measured in a plane transverse to said direction, decreases in said direction above the top of said shoulder.

5. The shoelace knot retainer of claim 2 or 3 wherein said sound-generation means is fixed to said wall by a rivet.

6. The shoelace knot retainer of claim 5 further comprising a removable cap for closing said opposite end, said sound-generation means is a bell, and a strap is fixed to said bell and said cap for preventing said cap from becoming detached from said bell.

7. The shoelace knot retainer of claim 6 wherein said protective means has a gap through which said strap passes.

8. A shoelace knot retainer comprising:

(a) hollow knot retaining means, (b) sound-generation means mounted on said knot retaining means, (c) protective means extending outwardly from said knot retaining means and at least partially surrounding said sound-generation means, (d) said sound-generation means having side walls which are spaced at a predetermined breadth, and then converge, and wherein (e) said protective means extends at least to the position of said predetermined breadth of said sound generation means.

9. The shoelace knot retainer of claim 8 wherein said sound-generation means is a bell.

* * * * *